United States Patent [19]

Franklin, Jr.

[11] Patent Number: 4,680,119

[45] Date of Patent: Jul. 14, 1987

[54] APPARATUS FOR INTRODUCING A GAS INTO A LIQUID

[76] Inventor: Grover C. Franklin, Jr., 2250 Warmouth St., San Pedro, Calif. 90732

[21] Appl. No.: 721,777

[22] Filed: Apr. 10, 1985

[51] Int. Cl.[4] ..... B01F 3/04

[52] U.S. Cl. ..... 210/512.1; 210/629; 210/219; 210/221.1; 261/93

[58] Field of Search ..... 261/93, DIG. 75; 210/512.1, 629, 219, 221.1

[56] References Cited

U.S. PATENT DOCUMENTS

| | | | |
|---|---|---|---|
| 721,036 | 2/1903 | Gwynne et al. | 261/DIG. 75 |
| 950,999 | 3/1910 | Erlwein et al. | 261/DIG. 75 |
| 1,144,342 | 6/1915 | Andrews . | |
| 1,808,956 | 6/1931 | Ketterer | 261/DIG. 75 |
| 2,141,047 | 12/1938 | Schulte | 261/93 |
| 2,825,691 | 3/1958 | Fischer | 210/219 |
| 3,032,496 | 5/1962 | Griffith . | |
| 3,452,966 | 7/1969 | Smolski . | |
| 3,953,003 | 4/1976 | Mahig | 261/DIG. 75 |
| 3,969,446 | 7/1976 | Franklin, Jr. | 261/77 |
| 4,186,094 | 1/1980 | Hellberg | 261/DIG. 75 |
| 4,374,030 | 2/1983 | Franklin, Jr. | 261/93 |
| 4,511,474 | 4/1985 | Krishna et al. | 210/512.1 |

*Primary Examiner*—Tim Miles

[57] ABSTRACT

An apparatus for introducing a gas into a liquid comprising a container, at least one vertical conduit in fluid communication with the container, the conduit having therein at least one mixer assembly for breaking up gas bubbles into bubbles having small diameters, and a means for introducing a gas into the conduit at a point below the mixer assembly, the mixer assembly comprising at least two freely rotating turbines which are spaced apart axially and have different direction or speed of rotation.

2 Claims, 4 Drawing Figures

102
80
99
98
102
96
IN
88
88
POSSIBLE AIR
90
84
84
AIR
86
82
AIR
86
106
104
104
92
100
SOLIDS OUT
98

APPARATUS FOR INTRODUCING A GAS INTO A LIQUID

BACKGROUND OF THE INVENTION

1. Field of the Invention

This invention relates to an apparatus for introducing a gas into a liquid. More specifically, this invention is directed to such an apparatus which requires little energy.

2. Description of the Prior Art

The simplest method of aeration comprises introducing a gas into a liquid through holes in an appropriate supply line. Some of this gas is absorbed as the gas bubbles rise through the liquid. Unabsorbed gas escapes from the surface of the liquid, and may or may not be captured for recirculation.

This method, though simple, is very inefficient. The gas bubbles, even if small when introduced into the liquid, tend, as they rise, to aggregate into large bubbles or slugs of gas. These gas slugs have comparatively small surface area to volume ratios. That is, there is relatively little gas-to-liquid contact, considering the volumes of the gas bubbles. This results in relatively low rates of gas absorption by the liquid at the liquid-gas interfaces. If the openings at the gas outlet are made very small to introduce small gas bubbles, fouling of the openings often occurs. Also, the transit time of the gas through the liquid may be quite short if the liquid container, for example a pond or holding tank, is shallow. This short gas-to-liquid contact time further results in an inefficient rate of gas absorption by the liquid. In addition, minimal turbulence is created for disrupting the liquid-gas interfaces, disruption and renewal of the interfaces being essential for high rates of gas absorption.

Some slight improvement in absorption efficiency is obtained by use, at the gas injection openings, of nozzles which introduce the gas into the liquid in a swirling manner so as to create some degree of turbulence. This also tends somewhat to delay formation of large gas slugs and somewhat to disperse the gas bubbles through a larger volume of liquid (for example, U.S. Pat. No. 3,276,698). High absorption efficiencies are still not obtained, however.

More commonly used processes employ the pneumatic (or air) lift pump principle. When a gas is bubbled up through an elongate tube which is vertically submerged in a liquid, the rising gas bubbles cause an upward lifting or flow of liquid through the tube. This upward flow of liquid causes a circulation within the entire body of liquid, liquid being continually drawn into the bottom of the tube and being discharged from the top thereof. Turbulence in the liquid above the top of the tube (which is normally submerged well below the surface of the liquid) tends to improve the absorption rate of the gas by breaking up, to some extent, large gas slugs (for example, U.S. Pat. No. 3,032,496) and by disrupting and renewing the liquid-gas interfaces. The liquid circulation and turbulence caused by such pneumatic lifts may also be used to prevent formation of ice on the surface of a liquid, or to reduce the magnitude of surface waves, for example in a harbor area. The absorption efficiency obtained is still much less than desired, however, because large gas slugs still tend to form and remain unbroken, and because the gas-liquid contact time is not appreciably increased. Therefore, a considerable amount of gas must be pumped through such pneumatic lift tubes in order that a small amount may be absorbed by the liquid. Because of the inefficient absorption process, much of the energy used to pump the gas is wasted.

Helical tube dividers installed in some pneumatic lift tubes (for example, U.S. Pat. Nos. 1,144,342 and 3,452,966 increase the gas-liquid contact time by providing increased path lengths for the gas bubbles to travel as they spiral up through the tubes. In addition, the gas and liquid exits from the tops of the tubes with a rotational motion, thereby somewhat increasing the turbulence thereabove. However, large slugs of gas still tend to form within the tubes, with consequent still relatively poor absorption efficiency. Some helical tube dividers (for example, U.S. Pat. No. 1,144,342) are provided with holes interconnecting the adjacent chambers to help prevent formation of large gas slugs. There is little tendency to produce small gas bubbles and the gas absorption efficiency is still much less than desired. Gas which is not absorbed in the bubble transit through the liquid is either lost or must be repumped through the liquid. This requires additional gas pumping capacity and horsepower.

Because of inefficiencies of present pneumatic lift tube aerators, it has been necessary to pump relatively large amounts of gas through the liquid—only a relatively small portion actually being absorbed by the liquid—and to employ a relatively large number of pneumatic lift tubes, particularly when the liquid is contained in shallow tanks or ponds and short tubes must be used. Thus, there has been considerable wastage of gas pumping power with resulting high costs involved in such complex aerator systems.

Some aerators include a motor-driven, horizontally rotating submerged turbine. The non-enclosed turbine is generally positioned above a source of gas bubbles and is used to break up and disperse the released gas bubbles and to create turbulence in the liquid. Other aerators employ motor driven, vertically rotating, non enclosed turbines or paddles at, or just below, the surface of a liquid. Such aerators usually rely upon the air above the surface of the liquid, some of which becomes entrapped in the churning liquid, for aerating. However, motor-driven aeration systems are expensive to produce, to operate and to maintain. A source of power for the motor must also be available.

U.S. Pat. No. 3,969,446 issued to the present inventor discloses an aerator which is adapted for total submersion into a body of liquid. When this aerator is submerged in a deep container or tank, it has been found that the pressure needed to force air through the aerator is substantial since the air has to overcome a large hydrostatic head.

Thus, there is a need for an aerating apparatus which requires little power to introduce the air into the liquid although the hydrostatic head which has to be overcome is substantial.

SUMMARY OF THE INVENTION

The present invention provides an apparatus for dispersing a gas into a liquid. The apparatus comprises a container, at least one vertical conduit disposed outside the container and having the upper end thereof connected to the top of the container and the lower end to the bottom of the container, the vertical conduit having therein at least one mixer assembly for dispersing a gas, and a pipe for introducing a gas into the conduit at a point below the mixer assembly. The mixer assembly comprises a plurality of turbines which are caused to rotate solely by the flow of a mixture of bubbles and liquid therethrough. The turbines are spaced axially apart. Adjacent turbines have different direction or speed of rotation in order to reduce the size of bubbles flowing therethrough. The bubbles in the vertical conduit reduces the energy needed at steady state to overcome the hydrostatic head of the liquid stored within the container. The presence of the small bubbles also ensures a large contact surface area for gas/liquid transfer.

In another embodiment of the present invention, the container is provided with tangential inlet and outlet ports and a conical bottom portion. A slurry of liquid and solid particles is introduced into the container through the tangential inlet situated near the top of the container. The twirling action of the slurry flow through the container causes the particles to move towards the outside of the container and can be drawn off through the conical bottom. The liquid is removed from the container through the tangential exit port near the bottom of the container.

DETAILED DESCRIPTION OF THE PREFERRED EMBODIMENTS

According to one embodiment of the subject invention, an apparatus for aerating a liquid stored within a container is provided. The aeration also causes circulation or pumping of the liquid within the container so that the present apparatus also can be used as a pumping or circulating device. A gas is introduced into the apparatus whereby it is broken into a multitude of small gas bubbles. The small bubble size provides a large gas/liquid contact surface. As a result, the amount of gas dissolved in the liquid is increased. The presence of bubbles in the vertical conduit substantially decreases the pressure needed to pump the gas into the liquid.

Figure 1:
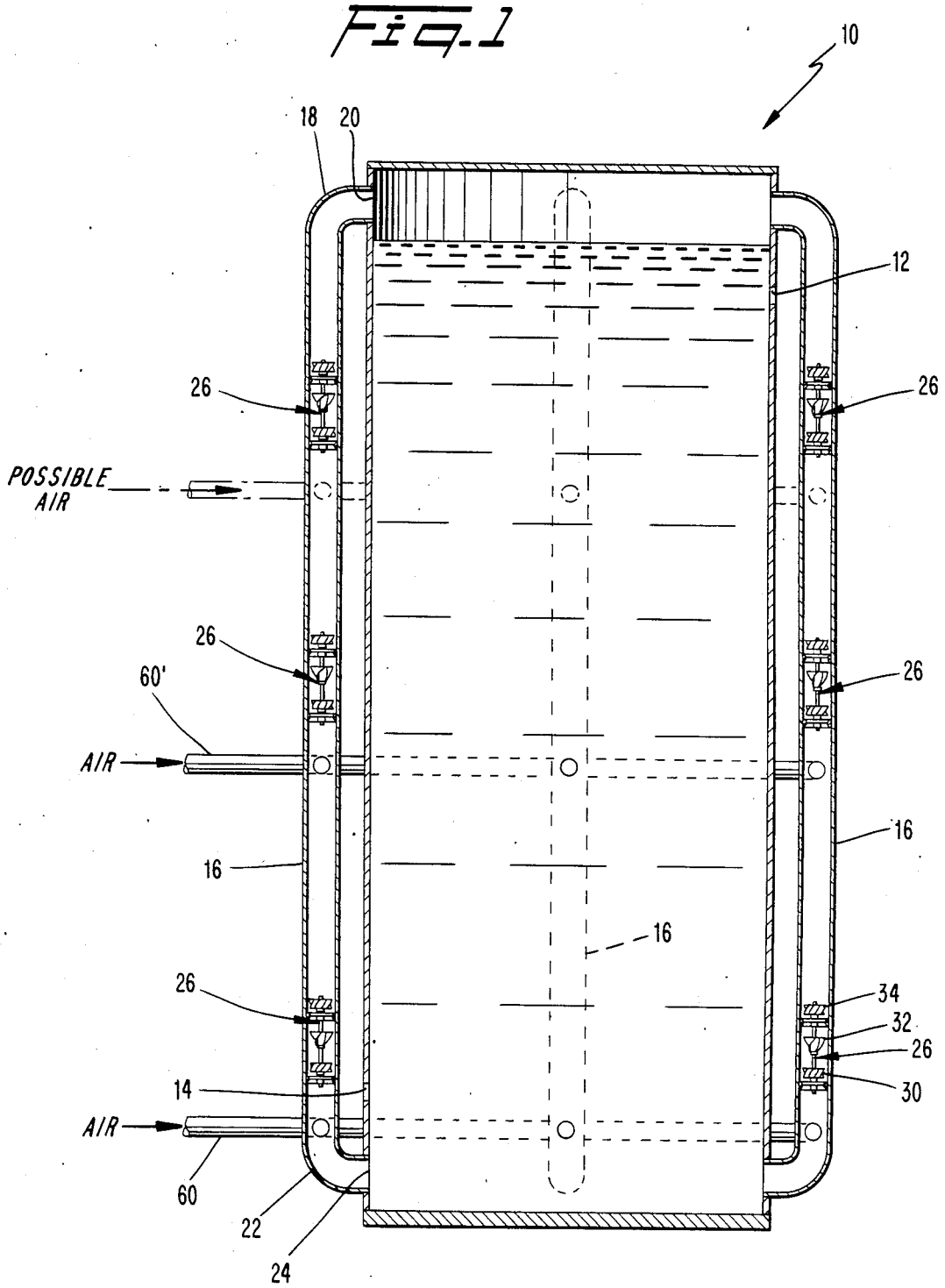
FIG. 1 is a cross-sectional view of one embodiment of this invention.

With reference to FIG. 1, the aerating/circulating apparatus comprises a container 10 having an outlet 12 at the top portion thereof and an inlet 14 at the bottom. Flow in and out of the container 10 via outlet 12 and inlet 14 is controlled suitable valving means (not shown). Container 10 typically has a cylindrical shape. Disposed outside the container 10 are a plurality of cylindrical vertical conduits 16 having one end 18 connected to the top of container 10 at 20 and the other end 22 connected to the bottom of container 10 at 24. It is noted that outlet 12 is placed below connection 20 at the top of container 10 whereas inlet 14 is placed above connection 24. Such an arrangement eliminates pockets of stagnant liquid within the container 10. In FIG. 1, two conduits 16 are shown attached to container 10. It should be understood that any convenient number of conduits 16 can be used in connection with container 10.

Figure 2:
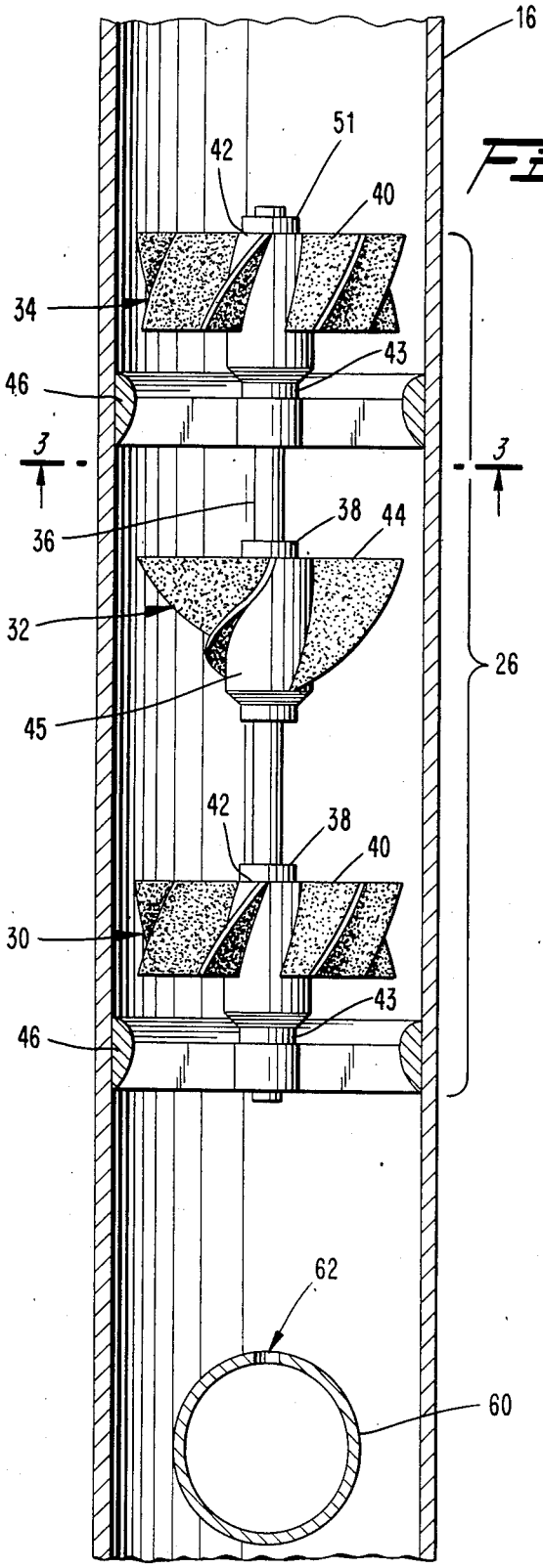
FIG. 2 is a cross-sectional view of mixer assembly.

Mounted within each conduit 16 is at least one mixer assembly 26 which comprises a first or lower turbine 30, a second or intermediate turbine 32 and a third or upper turbine 34. Although three turbines are shown, two or more than three turbines may be used. Turbines 30, 32 and 34 have diameters slightly less than the inside diameter of vertical conduit 16 and are rotatably mounted in an axially spaced relationship on an axially centered turbine shaft 36. It is shown in FIG. 2 that turbines 30, 32 and 34 are rotatably mounted on one common shaft 36. The turbines are preferably spaced about one conduit diameter apart and are maintained in a spaced relationship by suitable means, such as collars 38. The turbines are rotatably mounted on shaft 36 so that they are free to rotate independently and without the application of power.

In order to have substantially identical rotational speeds, turbines 30 and 34 are preferably identical. Both comprise a number of radial turbine blades 40 emanating from a central hub 42 having a streamlined upstream flow diverger 43. The turbine blades are such that the upward flow of liquid and gas through vertical conduit 16 causes the turbines 30 and 34 to rotate at relatively high speed.

Fewer turbine blades 44 on hub 45 are used on intermediate turbine 32. As a result, turbine 32 is caused to rotate at a considerably slower rate than turbines 30 and 34. Alternatively intermediate turbine 32 may have the same configuration as turbines 30 and 34 except the blades of turbine 32 are pitched at such an angle that turbine 32 rotates in a direction opposite to that of turbines 30 and 34. The different rotational speeds or directions of adjacent turbines ensures the breaking up of the gas bubbles from tube 60 into very small gas bubbles and thereby optimizes the dispersion of very small gas bubbles into the liquid.

Upwardly flowing gas and liquid in vertical conduit 16 act on the turbine blades and provide the only motive power to cause the turbines to rotate. As a result, the gas bubbles are broken up into a multitude of very small gas bubbles to provide a large gas/liquid surface area available for mass transfer. No external driving force such as a motor is needed or used to turn the turbines.

Figure 3:
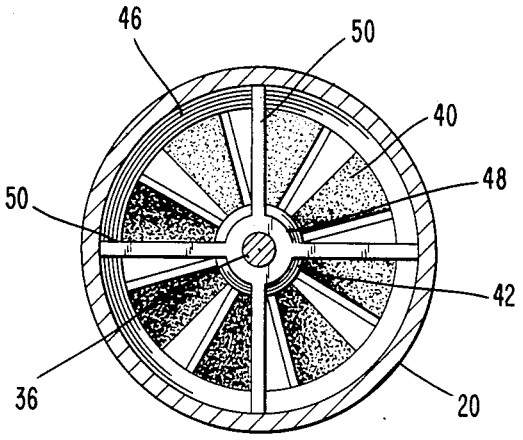
FIG. 3 is a cross-sectional view of an impeller in the mixer assembly.

Turbine shaft 36, upon which turbines 30, 32 and 34 are mounted, is maintained in position along the longitudinal axis of vertical conduit 16 by two or more annular rings 46, one being below and closely adjacent to turbine 30 and the other being below and closely adjacent to turbine 34. A central hub 48 (FIG. 3) at the intersection of cross members 50 having outer ends attached to rings 46 (as by being inset therein when the rings are molded or otherwise formed) supports the shaft 36 which may be either press fit therewithin and thus be nonrotatable, or which may be loosely fit therewithin and be rotatable. Longitudinal movement of the shaft is prevented by nuts 51 threaded on end portions thereof above the turbines 34 and below hub 48 of lower ring 46.

In the description above, three turbines are mounted on one common shaft 36, which has a length substantially that of mixer assembly 36. Alternatively, each of the turbines may be mounted on one short shaft which is attached to vertical conduit 16 in the manner described above. In this case, mixer assembly 26 comprises three separate turbine units.

Annular rings 46, preferably having a semicircular or arcuate cross section with the curved portion directed toward shaft 36, create a venturi effect to increase the upward flow velocity of the gas and liquid before they impinge upon turbines 30 and 34. This increased flow velocity into the turbines results in increased efficiency by increasing the rotational speed of the turbines.

Disposed below each mixer assembly 26 is a pipe 60 for introducing a gas into the mixer assembly 26. For economic reasons, when more than one vertical conduit 16 are used, a single pipe 60 can be utilized for introducing the gas into mixer assemblies 26 which are disposed at the same height or level within conduit 16. Pipe 60 is provided with holes 62 in the top portion thereof and at locations below mixer assembly 26 to allow air to flow into turbines 30, 32 and 34. In FIG. 1, two pipes 60 and 60' are shown although it is understood that one, two, three or more pipes can be used.

When a gas, such as air, is introduced through pipe 60 into vertical conduit 16, large bubbles are formed. As these bubbles rise within conduit 16, they encounter lower turbine 30, causing it to rotate which breaks the bubbles into smaller bubbles. When the swarm of rising smaller bubbles reaches intermediate turbine 32, the buoyant force of the bubbles causes turbine 32 to rotate. However, since turbine 32 rotates in a direction opposite to or at a different speed from that of turbine 30, the diameter of the bubbles are further reduced. When the bubbles reach upper turbine 34 they are sheared into even smaller bubbles since upper turbine 34 rotates in a direction opposite to or at a different speed from that of turbine 32. The net result is that the bubbles entering mixer assembly 26 are sheared or broken into a multitude of fine bubbles to provide a large surface area for gas/liquid contact. Accordingly, mixer assembly 26 provides an excellent means of introducing a gas into the liquid stored within container 10.

Thus, there is described an apparatus for introducing a gas into a liquid wherein the amount of energy required is substantially reduced. The presence of the bubbles in vertical conduit 16 reduces the hydrostatic head which the gas in pipe 60 must overcome which leads to savings in energy cost. As an example, for a container 10 having a height of 9 feet, the pressure needed to overcome the hydrostatic head at steady state is about 3,896 psig. By using one pipe 60 and one mixer assembly in each conduit 16, the pressure needed at steady state is about 2.1 psig. When two pipes 60 and 60' and two mixer assembly (one each above pipes 60 and 60', respectively) are used, the steady state pressure is further reduced to 1.75 psig. Thus, the improvement brough forth by the present apparatus is substantial.

The present apparatus can be used to introduce oxygen into ground water which is to be pumped into fish ponds. For the fish to grow, a high oxygen content is needed. However ground water typically has a very low oxygen content and must be aerated before such use. The present apparatus provides an efficient and economical apparatus for such purpose.

Figure 4:
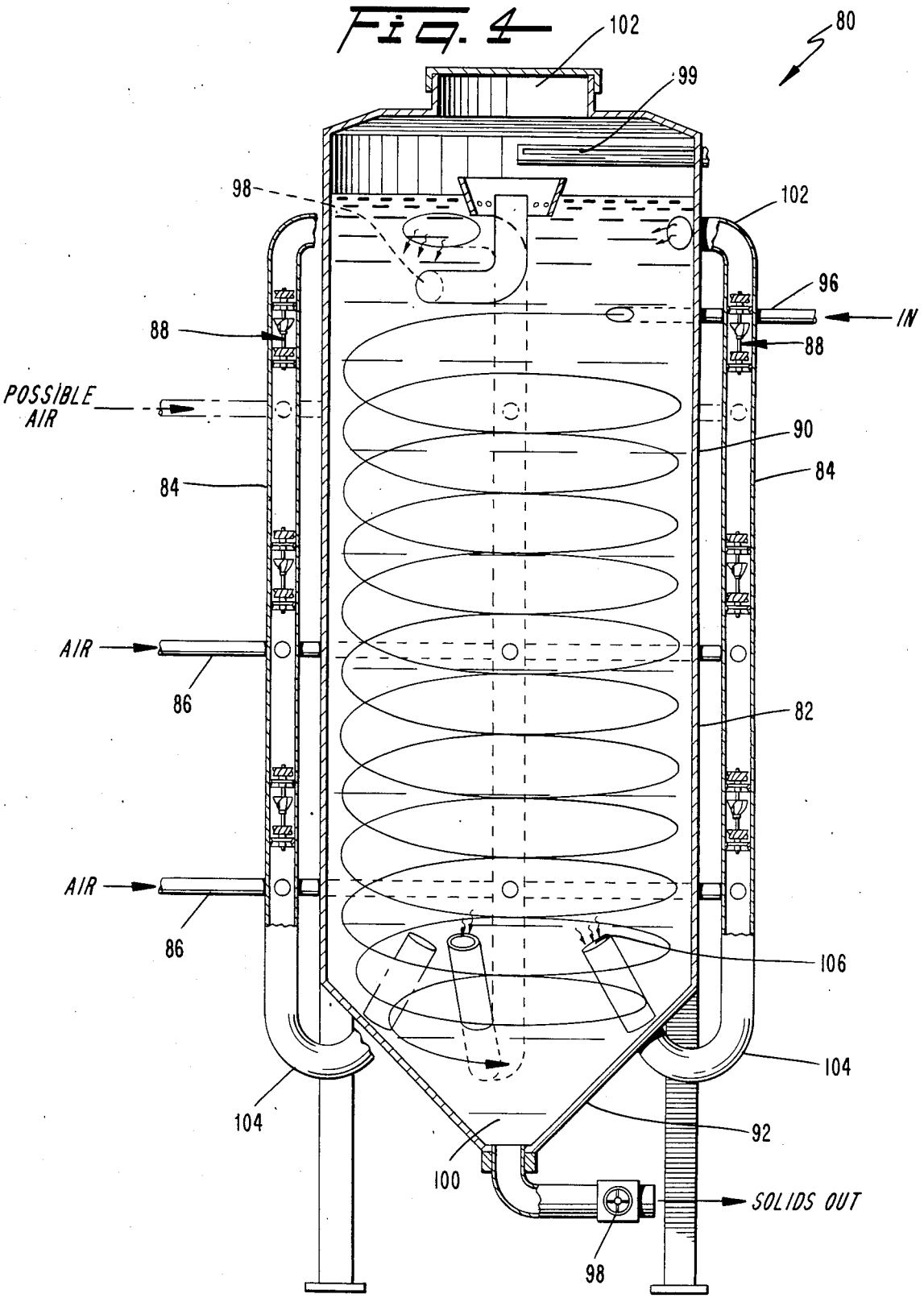
FIG. 4 is a cross-sectional view of another embodiment of this invention.

In another embodiment of the present invention, an apparatus which can perform aeration and separation functions is provided. Such an embodiment is shown in FIG. 4. In FIG. 4, the apparatus 80 comprises container 82 having connected thereto a plurality of vertical conduits 84 and gas supply pipes 86. Disposed within each conduit 84 is at least one mixer assembly 88. The construction and function of mixer assembley 88, pipe 86 and conduit 84 are similar to those of mixer assembly 26, pipe 60 and conduit 16, respectively, described above and will not be repeated here. Container 82 comprises a cylindrical body portion 90 and conical bottom portion 92 in fluid communication with body portion 90. Near the top of container 90 and below the liquid surface, tangential inlet 96 for a liquid or slurry is provided. Located above inlet 96 is outlet 98 for container 90. As shown in FIG. 4, outlet 98 is disposed near the center of container 90 and at the liquid surface so as to avoid the possibility of particles escaping from the container through this outlet. Optionally, a skimmer 99 may be included above the liquid surface for eliminating foam build-up. Conical bottom portion 92 is provided with a valve 98 for the withdrawal of solids collected in the apex 100 thereof.

Each vertical conduit comprises an upper end 102 and bottom portion 104 which are connected to container 90. Upper end 102 is connected to container 90 tangentially to assist in imparting a twirling motion on the contents stored within container 90. Bottom portion 104 of conduit 84 is bent upwards with open end portion 106 being located near the center of container and away from the walls of container 90 and conical bottom 92. By so locating end portion 106, the probability of solid particles exiting therethrough is greatly reduced. Bottom portion 104 penetrates container 90 near the bottom of the cylindrical section of the container. As has been mentioned, each conduit 84 is provided with at least one mixer assembly 88.

A slurry comprising a liquid and solid particles is introduced into container 80 through tangential inlet port 96. As a result of the tangential input, the slurry is subjected to a twirling action as it spirals down body portion 90. The velocity profile of the liquid relative to the distance from the container wall causes the particles to congregate near the wall of body portion 90 and conical bottom portion 92, thus permitting a liquid stream which contains no particles to be removed from container 80 via exit port 98. As mentioned above, the solid particles are removed from container 80 through valve 98.

The gas to be introduced into the liquid in vertical conduit 84 is fed to container 80 via pipe 86. To prevent excessive build-up of pressure within container 80 which leads to increased pressure required in forcing the gas into the liquid, container 80 is preferably provided with a covered vent 102 at the top thereof.

As has been explained hereinabove, by using the vertical conduit having therein at least one mixer assembly, the pressure needed to introduce the gas into container 80 at steady state is substantially reduced as compared to the case where no mixer assembly is used. In addition, by using the mixer assembly, the gas is introduced into the liquid more efficiently due to the presence of a large contact surface area provided by the small gas bubbles.

The apparatus according to the present invention can be formed of any suitable material. For example, containers 10 and 80 and conduits 16 and 84 may be metallic or plastic. Mixer assemblies 26 and 88 are preferably made of a plastic material such as Nylon, polyvinyl chloride, pipes 60 and 86 may be metallic or plastic.

With reference to the sizes of conduits 16 and 84, containers 10 and 80, and pipes 16 and 86, these can be adjusted according to need. Mixing assembles 26 and 88 usually have the same size as conduits 16 and 86, respectively.

What is claimed is:

1. An apparatus for simultaneously separating solid particles from a liquid and aerating the liquid comprising:

a container having an upper cylindrical section and an inverted conical bottom portion, a valving means being provided at the apex of the conical section for removal of solid particles from the container, a tangential inlet and a central outlet being provided in the top section thereof, at least one vertical conduit in fluid communication with the container, the conduit having an upper end connected tangentially to the top of the container and below the tangential inlet and central outlet, and a bottom portion which is bent upwards and penetrates the container near the bottom of the cylindrical section of the container, the open end of the bottom portion being disposed near the center of the container, the conduit having disposed therein at least one mixer assembly, each assembly comprising a plurality of turbines, the turbines being free to rotate, spaced apart vertically and having different speeds or directions of rotation; and means for introducing a gas into the conduit at a point below the mixer assembly.

2. The apparatus of claim 1 wherein two mixer assemblies are disposed within each vertical conduit, one near the bottom and the other in the middle portion thereof, a means for introducing a gas into the conduit being disposed below each mixer assembly.

* * * * *